US006546898B1

(12) United States Patent
Rocheleau

(10) Patent No.: US 6,546,898 B1
(45) Date of Patent: Apr. 15, 2003

(54) HYDRONIC HEATING SYSTEM AND KIT

(76) Inventor: John W. Rocheleau, 82 Warren St., Apt. 2, Concord, NH (US) 03301

( * ) Notice: Subject to any disclaimer, the term of this patent is extended or adjusted under 35 U.S.C. 154(b) by 0 days.

(21) Appl. No.: 09/981,376

(22) Filed: Oct. 16, 2001

(51) Int. Cl.[7] ..... E03B 7/07

(52) U.S. Cl. ..... 122/235.29; 122/411; 237/8 C; 137/563

(58) Field of Search ..... 122/235.15, 235.21, 122/235.29, 360, 408.1, 411, 414, 511, DIG. 11; 110/325; 237/8 C; 137/552, 563

(56) References Cited

U.S. PATENT DOCUMENTS 2,265,108 A * 12/1941 Berman ..... 122/414
4,386,500 A * 6/1983 Sigafoose ..... 62/79
5,119,988 A * 6/1992 Fiedrich ..... 237/8 C
5,707,007 A * 1/1998 Fiedrich ..... 237/8 R

* cited by examiner

*Primary Examiner*—Gregory Wilson
(74) *Attorney, Agent, or Firm*—Michael J. Pearson; Lawson & Persson, P.C.

(57) ABSTRACT

A hot water heating system, and kit for installing such a system, that utilizes male and female union connections for all main heating system components allows the system to be completely installed using only two ordinary wrenches. The system includes a first isolator valve, a flow control valve, a circulator and a second isolator valve. Each of these components is equipped with one male union type connection on one side of the component and one female union type connection on the other side. The system may be an installed system or may entail a kit of parts for installation.

20 Claims, 7 Drawing Sheets

HYDRONIC HEATING SYSTEM AND KIT

FIELD OF THE INVENTION

The present invention relates to the field of heating systems and, in particular, to hot water heating systems for commercial and residential buildings.

BACKGROUND OF THE INVENTION

Hot water heating systems are alternatives to other conventional heating systems such as forced hot air, steam, and electric elements. The typical hot water heating system includes a boiler for heating water, a flanged pump for moving the heated water, a flow control valve, and any number of isolation valves that allow the components to be isolated from a supply pipe that transfers the heated water to a flexible heating pipe, radiator or convector.

There are a number of current hot water heating systems utilizing the above mentioned components. One such heating system is a radiant floor heating system in which a flexible heating pipe is typically embedded throughout, or under, the floor of the room to be heated. Another is a hot water system utilizing radiators or convectors in which the hot water is fed to steel or copper fin tube baseboard, freestanding cast iron radiator units, or a convector coil. In each of these systems, once the hot water has flowed through the heating pipe, radiator or convector, the heated water continues through a return pipe back to the boiler for reheating, thus closing the loop.

One problem with current hot water systems is the time required to install them. Typically these piping systems use flanges, threaded fittings, black steel pipe, or sweat fit copper tubing, which is extremely labor intensive to install. Manufactured steel and copper piping or tubing come in straight runs and fittings for accommodating turns and curves. Each connection of a straight run with a fitting requires either a threaded or a sweat fitted solder connection and a substantial amount of installation labor is involved in making each joint.

In cases where threaded connections are to be made, the pipe must be cut to the appropriate length, and then the threads must be cut on the end of the pipe using a pipe threading die. Next the threads must be dressed, cleaned and coated with a sealing compound, or a "TEFLON®", or other synthetic resinous fluorine, tape, to prevent leaks. Finally, the connector must be screwed to the pipe end with sufficient thread contact to prevent leaks.

In the case of sweat fit solder joints, the labor is comparable in that the tubing must be cut to the proper length, the end of the tubing and the fitting must be dressed and fluxed and the joint must be heated to the proper temperature with a torch to effect a satisfactory solder joint. Once joined, the solder connection must then be cleaned of any residual flux that, if left uncleaned, would corrode the joint once exposed to moisture.

In the case of flanged connections, such as those found on virtually all current circulators, the attachment is even more labor intensive. Circulator flanges are typically elliptical in shape and do not readily accommodate a standard pipe wrench or other tightening device. In addition, when the elliptical ends of the flange have turned within the 180 degrees tightening arc, the wrench must be readjusted, necessitating many fatiguing and time consuming iterations to complete the task. Moreover, as the size of a pipe wrench increases, the length of the handle increases proportionally. As pipe flanges must often be attached to a circulator that is extremely close to a wall, other pipes, or even worse, a corner, the use of a long handled pipe wrench or a pry-bar and long stove bolts to attach the flange to the pipe makes this job a tiring and time consuming one. Finally, once attached to the pipe, gaskets must be installed between the flanges and bolts secured to each flange to make the connections watertight. The inventor's pipe flange and sweat flange, described and claimed in U.S. patent application Ser. No. 09/179,584, and U.S. Pat. No. 6,283,157, respectively, ease this installation job somewhat. However, each still requires many of the same steps required for installing threaded or sweat copper connections, and each still requires the use of gaskets and bolts to secure the flanges to one another.

Another reason for the increase in installation cost is the fact that most systems are customized for the particular location in which they are to be installed. This requires that a variety of parts, having a variety of different connections, be used to piece the system together. Further, careful attention must be paid to insure that all components are installed in the correct position relative to the flow direction of the heating water. Because of this, current systems must be installed by trained professionals who have the tools and the know-how to properly assemble such customized systems.

Finally, the replacement of failed components in current systems requires that pipes be cut, rusted bolts be removed, worn gaskets be replaced, etc. This, again, increases the complexity of the work to be performed and mandates that trained professionals undertake any repair work on current systems.

Therefore, there is a need for a hot water heating system that is easily adapted for a variety of applications, that employs fewer joints requiring sealing compounds, solder, gasketing materials, or expensive tools to install than conventional systems, that insures that all components are in the proper position relative to water flow direction, and that allows failed components to be quickly and easily replaced without the need for professional assistance.

SUMMARY OF THE INVENTION

The present invention is a hot water heating system that overcomes the drawbacks of traditional systems. The system of the present invention utilizes male and female union connectors for all main heating system components and, therefore, allows the system to be completely installed using only two ordinary wrenches.

In its most basic form, the system of the present invention includes a first isolator valve, a flow control valve, a circulator and a second isolator valve. Each of these components is equipped with one male union type connector on one side of the component and one female union type connector on the other side of the component, such that, for example, all inflow sides utilize male type connectors and all outflow sides utilize female type connectors. These union connectors are sized to allow the components to be quickly and easily attached together in the proper orientation relative to one another. Further, the systematic nature of the components, i.e. male on one side and female on the other side, prevents the inadvertent installation of any component in the wrong flow direction.

In embodiments of the system utilized with radiant manifolds and radiant emitters, the present invention also includes a microbubble vent, a flow control valve, a tempering valve, and a tee connection with a temperature gauge or temperature sending unit. Each of these components is equipped with union connections arranged in the same manner, i.e. the male on inflow side/female on outflow side configuration, as described above.

In embodiments of the system utilized with hot water radiator type heating systems, the present invention includes an air scoop in addition to the first isolator valve, flow control valve, circulator, and second isolator valve. As was the case above, each of these components is equipped with union connections arranged in the same manner, i.e. the male on inflow side/female on outflow side configuration.

In one preferred embodiment of the invention, a system is sold as a kit of parts having all necessary components and branch connectors to install the system. In such a kit, all components will be fitted with male and female union connections and each may be readily installed together utilizing only two wrenches.

Therefore, it is an aspect of the invention to provide a hot water heating system that is easily adapted for a variety of applications.

It is a further aspect of the invention to provide a hot water heating system that employs fewer joints requiring sealing compounds, solder, gasketing materials, or expensive tools to install than conventional systems.

It is a further aspect of the invention to provide a hot water heating system that insures that all components are in the proper position relative to flow direction.

It is a further aspect of the invention to provide a hot water heating system that allows failed components to be quickly and easily replaced without the need for professional assistance.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
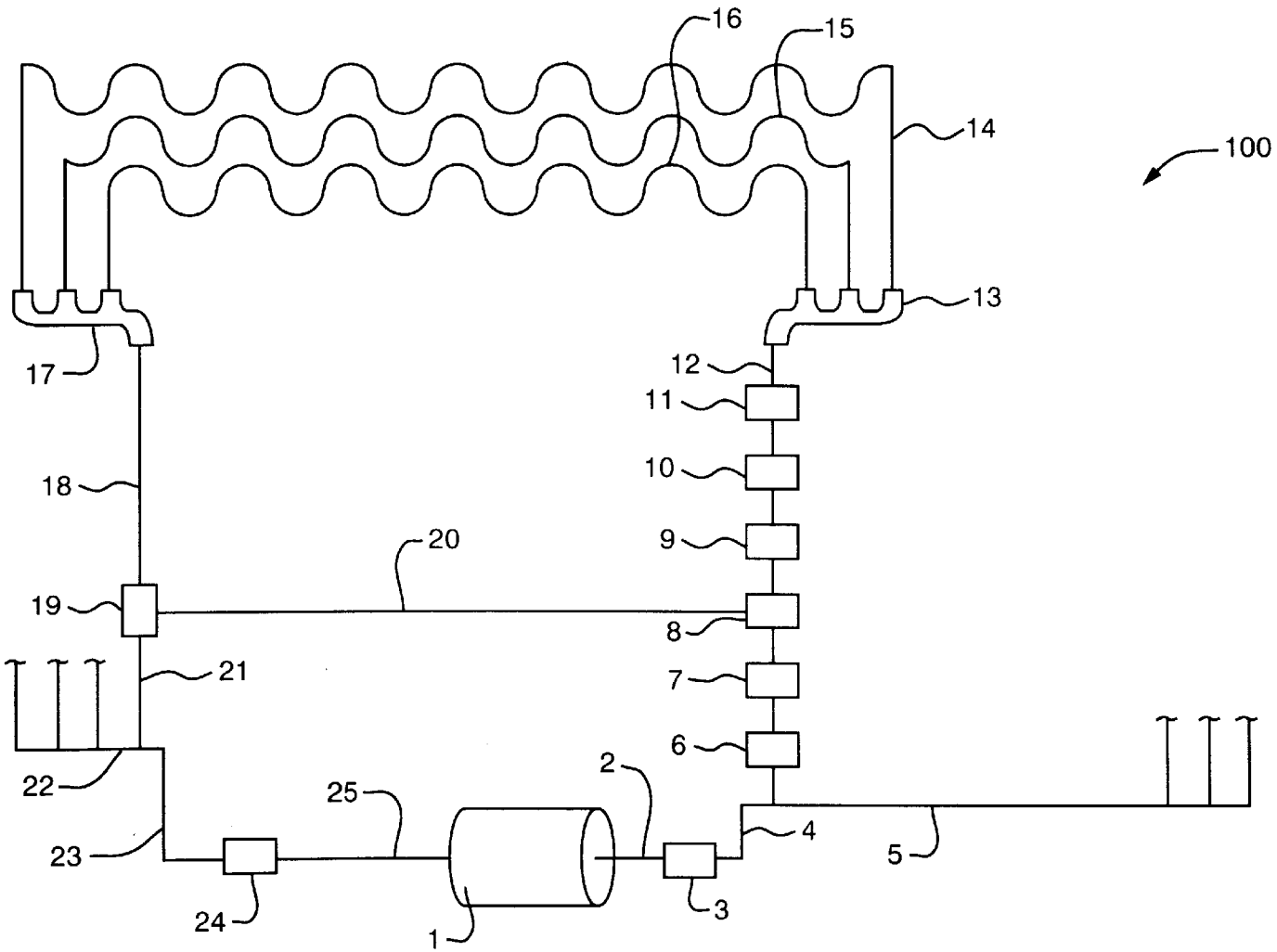
FIG. 1 is a diagrammatic view of a radiant hot water heating system.

FIG. 1 is a diagrammatic representation of a radiant hot water heating system 100. Boiler 1 produces a hot liquid; typically water, which is transported through the system 100 by means of circulator 10. After leaving the boiler 1 the liquid enters connection pipe 2 and flows into micro-bubble vent 3 where the liquid is de-gassed. The liquid then flows via connection pipe 4 into a zone distribution manifold 5. It is noted that a system 100 such as this will typically have two or more zones but, for clarity, only one zone is detailed in the FIG. 1.

After leaving the zone distribution manifold 5, the liquid flows in series through a first isolator valve 6, flow control valve 7, tempering unit 8, tee connection mounted temperature gauge 9, circulator pump 10, and a second isolator valve 11. After leaving the second isolator valve 11 the liquid flows through connection pipe 12 into the radiant tube distribution manifold 13.

The radiant tube distribution manifold 13 divides the liquid flow into a plurality of radiant tubes 14, 15 and 16 respectively. Three radiant tubes 14. 15 and 16 are shown purely as an example, and the number of tubes used in an actual system is dependent on the size and shape of the area to be heated as well as the desired emission region, e.g., from the floor. The liquid passes through the radiant tubes 14, 15 and 16 and then enters the radiant tube return manifold 17 where it is reunited as a single liquid flow.

The liquid leaves radiant tube return manifold 17 via return pipe 18 and flows into tee connection 19. A portion of the liquid flow exits tee connection 19 via tempering feedback pipe 20 and flows into tempering unit 8, where it is used to reduce the temperature of the heated water from the boiler 1 to a desired temperature. This tee connection 19 may also include all male and female portions of union connections, or it may include a combination of union connections and other conventional connections, such as solder connection, barbed connections, threaded connections or the like. The remainder of the liquid flow exiting the tee connection 19 flows into the zone return manifold 22 via connection pipe 21. The liquid flow then leaves zone return manifold 22 via connection pipe 23 and flows through purge valve 24 and connection pipe 25 into boiler 1, effectively completing the flow circuit.

Figure 2:
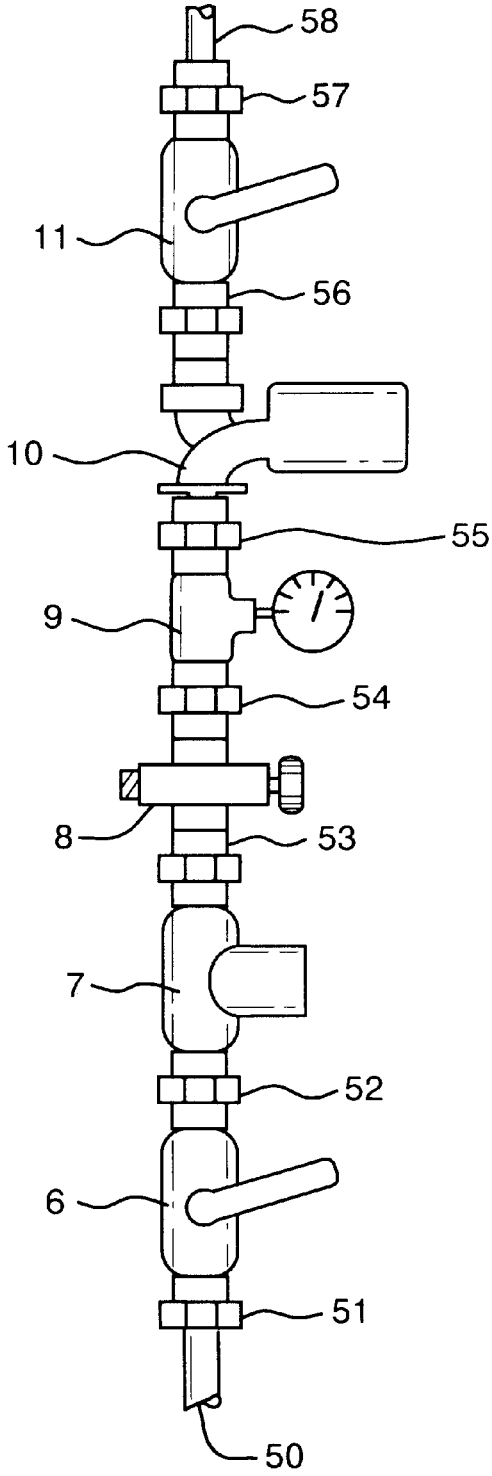
FIG. 2 is a view of the component and union connection arrangement for a radiant hot water heating system.

FIG. 2 shows the first isolator valve 6, flow control valve 7, tempering unit 8, tee connection mounted temperature gauge 9, circulator pump 10, and second isolator valve 11 of the radiant hot water heating system 100 of FIG. 1, and their arrangement with union connections 51, 52, 53, 54, 55, 56 and 57. Union connection 51 joins isolator valve 6 to upstream heating components, for example to a connection pipe 50 as shown. Union connection 52 joins isolator valve 6 to flow control valve 7. Union connection 53 joins flow control valve 7 to tempering unit 8. Union connection 54 joins tempering unit 8 to tee connection mounted temperature gauge 9. Union connection 55 joins tee connection mounted temperature gauge 9 to circulator 10. Union connection 56 joins circulator 10 to isolator valve 11. Union connection 57 joins isolator valve 11 to downstream heating components, for example to a connection pipe 58 as shown.

Figure 6:
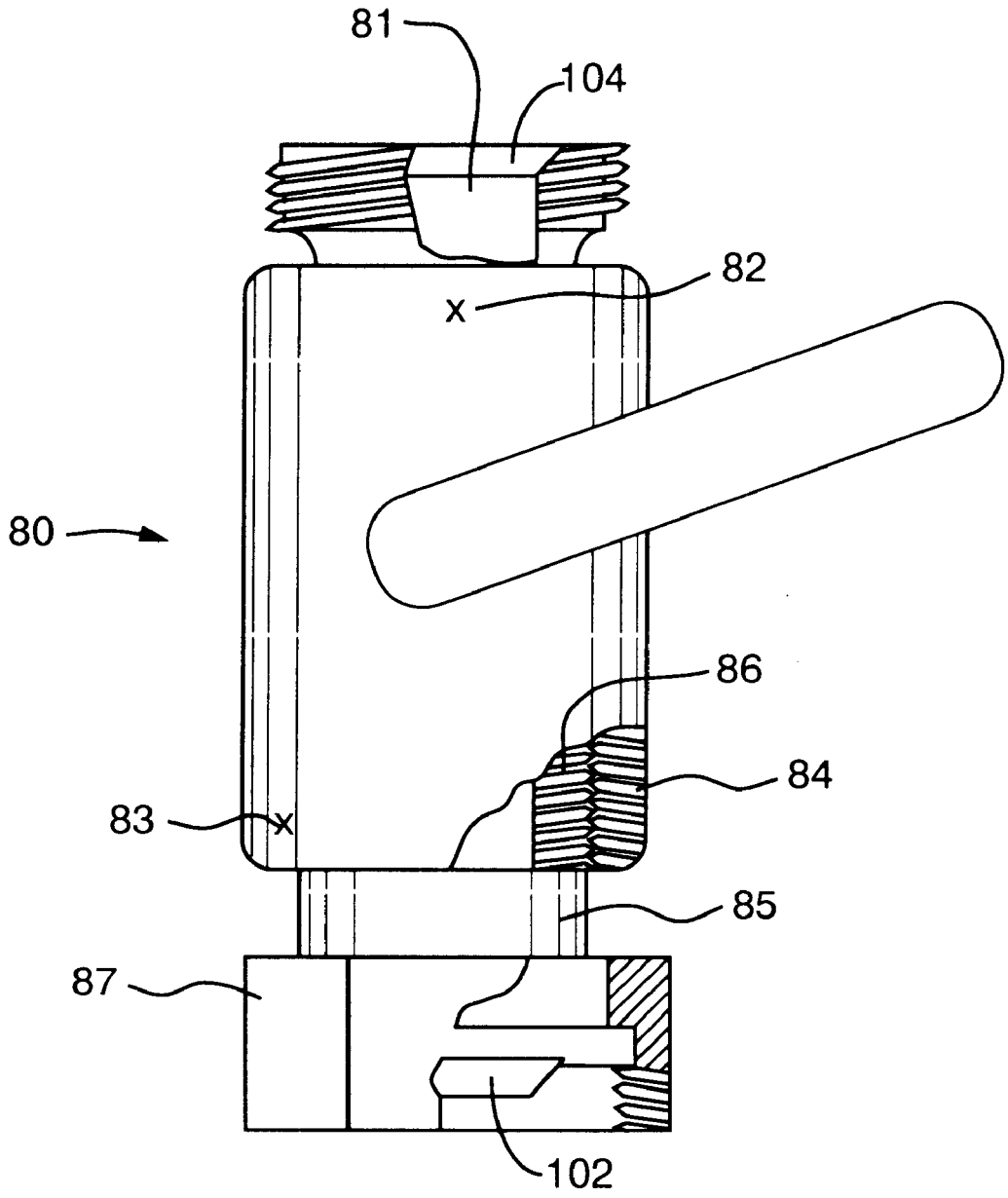
FIG. 6 is a partial cut-away view of a component and union connection assembly with the female union connection integral with component and the male union connection threaded into the component.
Figure 7:
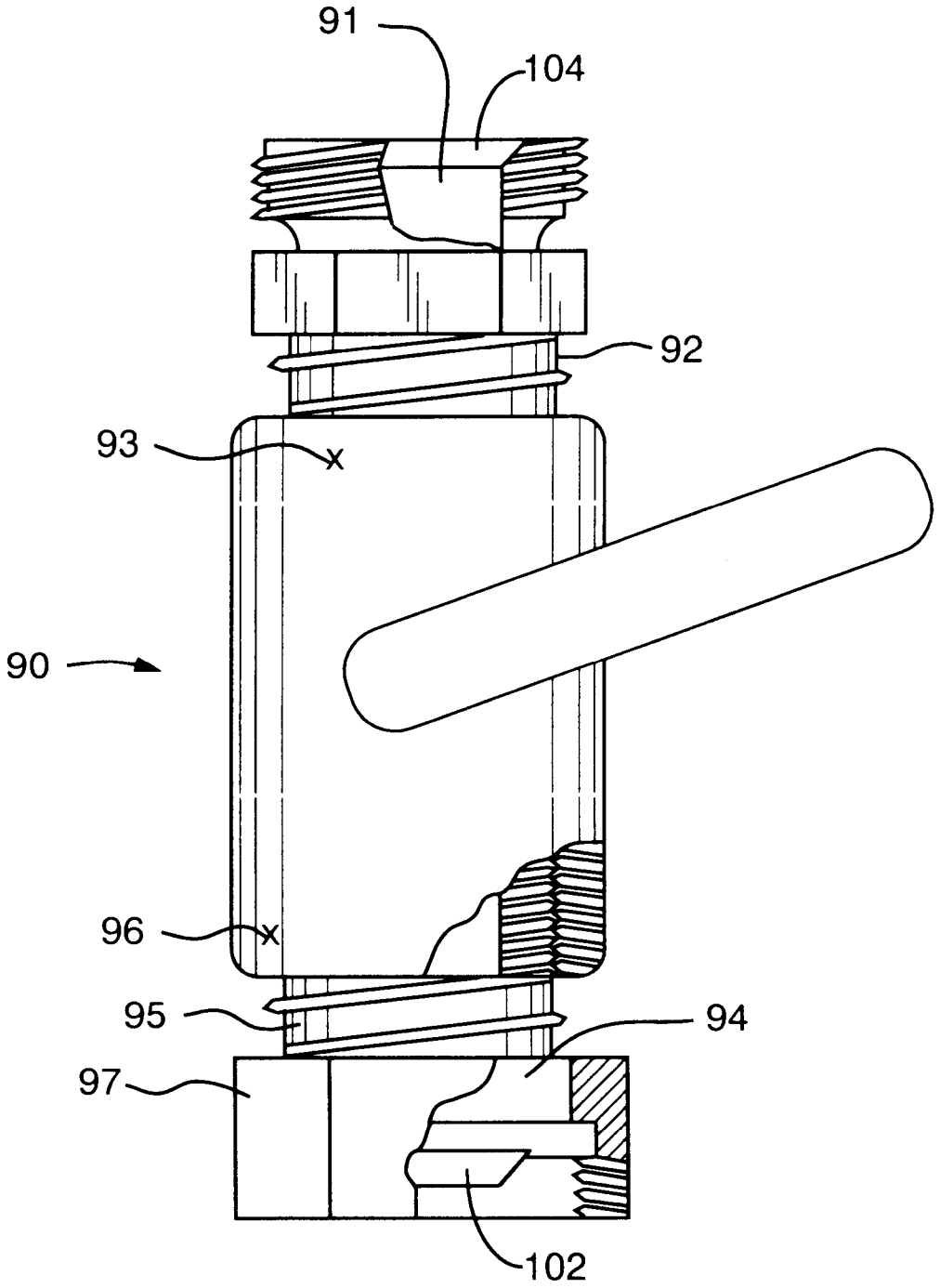
FIG. 7 is a partial cut-away view of a component and union connection assembly with nipple sections joining the male and female union connections to the component.

In the arrangement shown in FIG. 2, each component 6, 7, 8, 9, 10 & 11 has a male portion of a union connection at one end and a mating female portion of a union connection at the opposite end, similar to the arrangement shown in detail in FIGS. 6 & 7. This allows the male portion of one component to easily connect to the female portion of an adjacent component, effectively forming union connections 51, 52, 53, 54, 55, 56 and 57 between each. It is noted that the male and female portions of the connections 51, 52, 53, 54, 55, 56 and 57 need not be on any specific end, but that all upstream ends should have the same male or female portion and, likewise, all downstream ends should have an opposite portion. Thus, by identifying the flow direction on a single component; the circulator 10, for example, all other components will necessarily be installed in their proper orientation.

Figure 3:
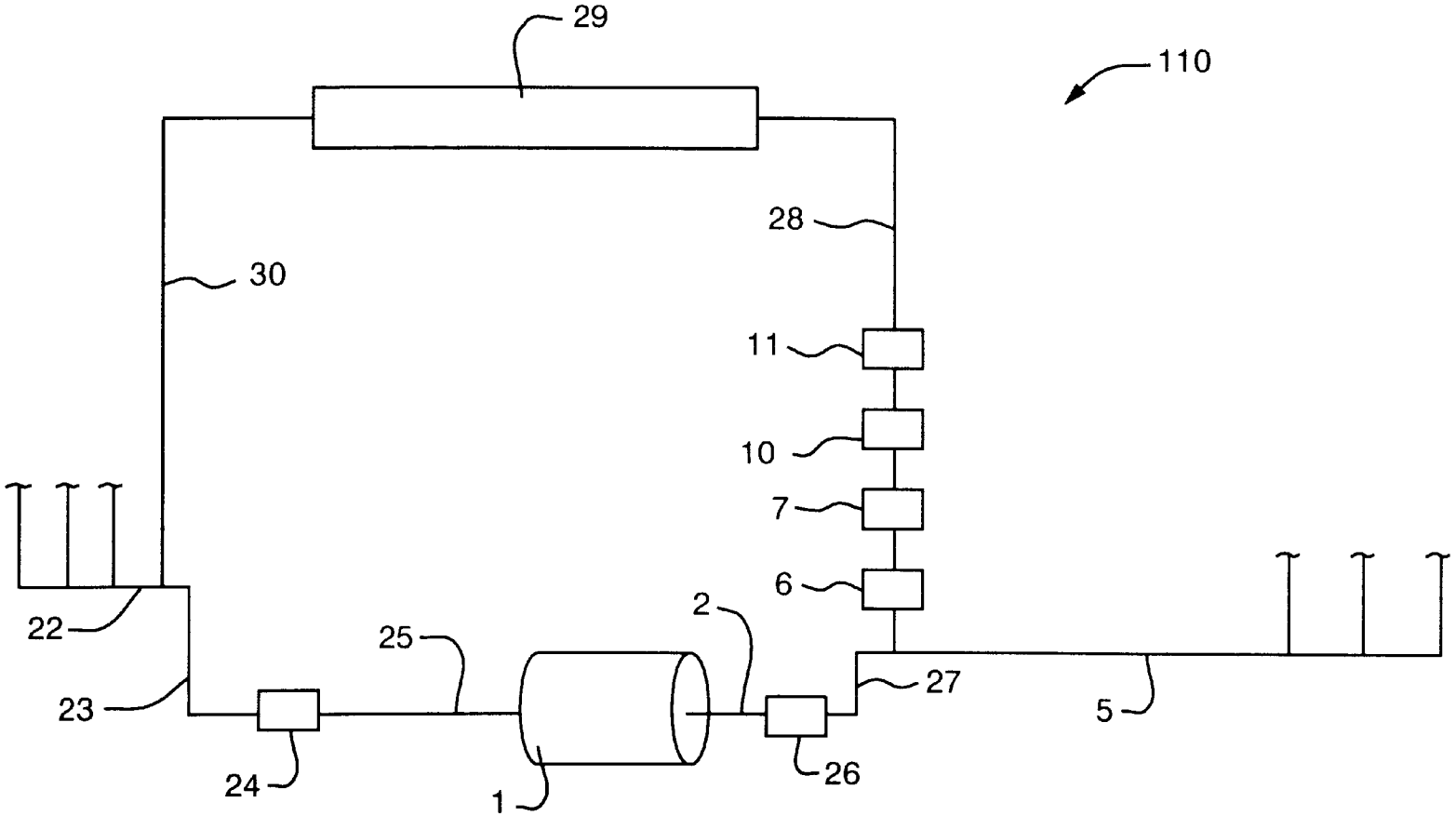
FIG. 3 is a diagrammatic view of a radiator type hot water heating system.

FIG. 3 is a diagrammatic representation of an alternate embodiment of the invention as applied to a radiator type hot water heating system 110. As with the radiant hot water system 100 of FIG. 1, boiler 1 produces a hot liquid, which is transported through the system by means of circulator 10. After leaving the boiler the liquid enters connection pipe 2 and flows into air scoop 26 where the liquid is degassed. This air scoop 26 performs essentially the same function as the microbubble vent 3 of the radiant system 100, but is less expensive than the microbubble vent 3 and provides sufficient degassing in a radiator type hot water system 110.

After it has been degassed, the liquid then flows via connection pipe 27 into a zone distribution manifold 5. As was the case with the radiant system 100 described above, a system 110 such as this will typically have two or more zones, but only one zone is detailed in the FIG. 2. After leaving the zone distribution manifold 5 the liquid flows in series through a first isolator valve 6, flow control valve 7, circulator 10, and a second isolator valve 11.

After leaving the second isolator valve 11, the liquid flows through connection pipe 28 and into baseboard radiator 29. It is noted that a baseboard type radiator is used purely as an example but other varieties of liquid-to-air, liquid-to-liquid or liquid-to-solid heat exchangers could also be used with the present invention. The liquid flows from baseboard radiator 29 via connection pipe 30 and enters zone return manifold 22. The liquid flows from zone return manifold 22 to purge valve 24 via connection pipe 23. The liquid leaves purge valve 24 through the connection pipe 25 and returns to boiler 1 completing the flow circuit.

Figure 4:
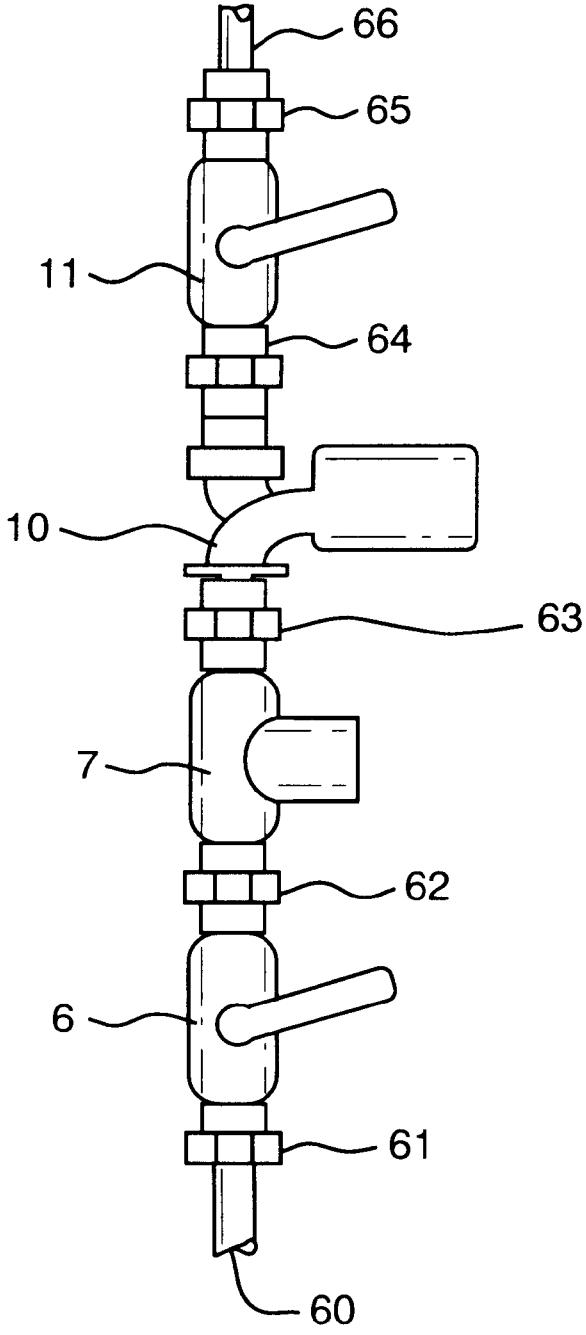
FIG. 4 is a view of the component and union connection arrangement for a radiator type hot water heating system.

FIG. 4 shows the first isolator valve 6, flow control valve 7, circulator pump 10, and second isolator valve 11 of a baseboard radiator heating system 110 and their arrangement with union connections 61, 62, 63, 64 and 65. Union connection 61 joins isolator valve 6 to upstream heating components, for example to a connection pipe 60 as shown. Union connection 62 joins isolator valve 6 to flow control valve 7. Union connection 63 joins flow control valve 7 to circulator 10. Union connection 64 joins circulator 10 to isolator valve 11. Union connection 65 joins isolator valve 11 to downstream heating components, for example to a connection pipe 66 as shown.

Figure 5:
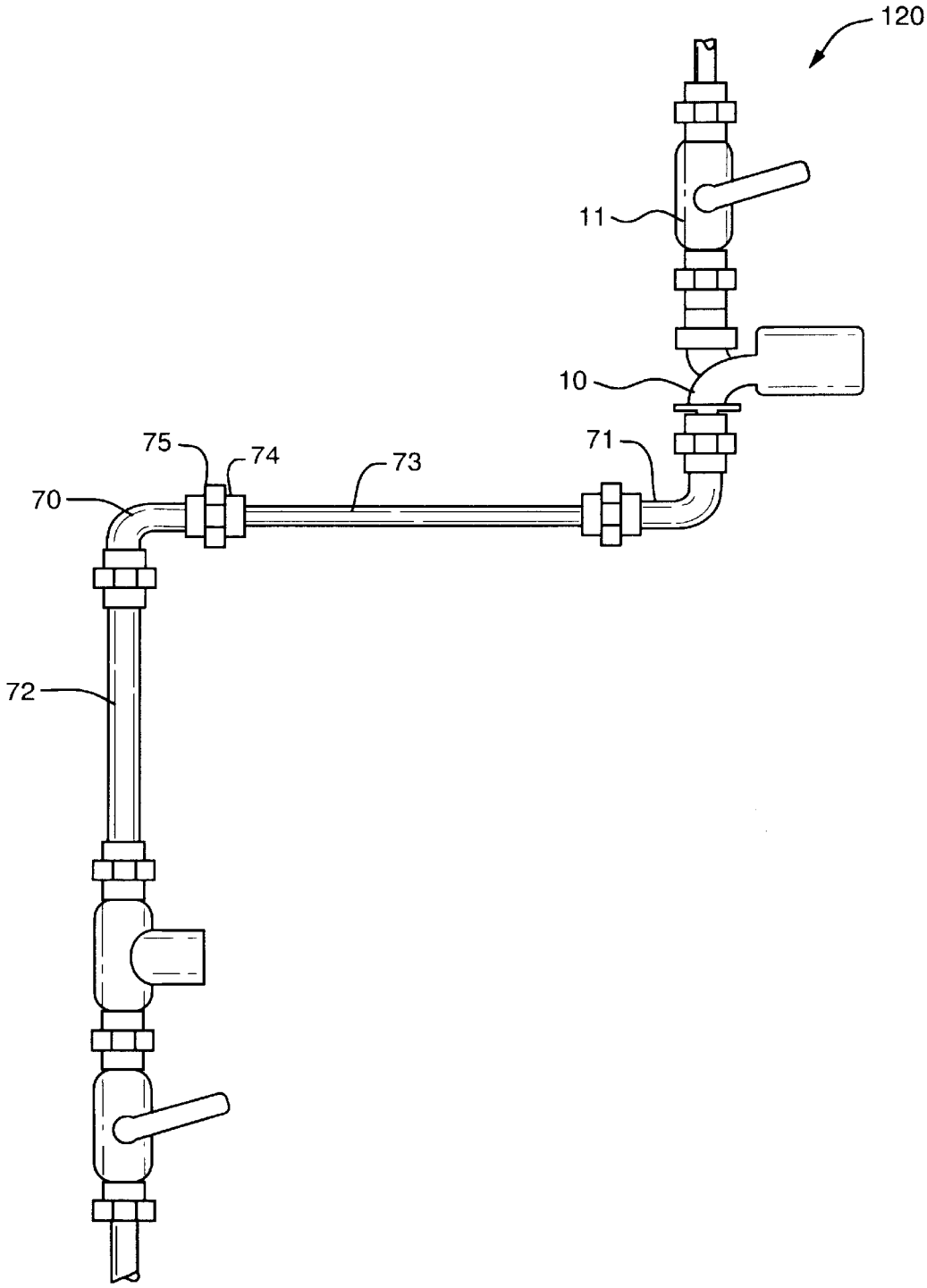
FIG. 5 is a view of the component and union connection arrangement for a radiator type hot water heating system with the use of a offset connector.

FIG. 5 shows one variation of the system 110 of FIG. 3 in which the components are not disposed in line with one another. In this system 120, a plurality of offset connectors, here a pair of 90° elbows 70 and 71 and an extension pipes 72 and 73 each fitted with male 74 and female 75 portions of union connections, are used to offset the system sideways. The ability to offset the system is important due to space considerations and obstacles that are found in particular installations. Therefore, although this system 120 is shown as only including a pair of 90° elbows 70 and 71 and extension pipes 72 and 73, it is envisioned that other systems and kits will include a plurality of offset connectors, including tees, forty-five degree elbows, union to copper or union to threaded adaptors, nipples, or the like.

It is envisioned that the components that make up the various systems will be sold in kit form, which will include all of the necessary components and offset connectors to accommodate any installation. As was the case with the system, at least the main system connections, i.e. connections between the isolator valves, circulator and flow control, will each be union type connections. However, it is likewise recognized that there may be some parts, such as the connections from the boiler, or the return to the tempering valve in the radiant hot water system, that utilize connections other than union connections, and all embodiments of the present invention should not be so limited.

In the preferred embodiments of the system and kit, the female union type connections are integral to the components themselves. An example of an isolator valve 80 having such integral connections is shown in FIG. 6. In such an arrangement, the female union connector 81 is formed integral to the second end 82 of the body of valve 80 during the manufacture of the valve 80, while the first end 83 of the body of valve 80 includes female threads 84 to which the male connector 85 is attached. As shown in FIG. 6, the male connector 85 in this embodiment includes a threaded end 86 that threads into the female threads 84 in the first end 83 of the body of valve 80 and captures a nut 87 that mates with the threads of the female connector of an adjacent component (not shown).

Although the components of the preferred embodiments have been described as having integral female connectors, it is also recognized that similar results may be achieved by utilizing standard components and fitting them with the desired portions of the male and female union connectors. This may be accomplished by adding nipples or other adaptors to the male and female connectors to allow them to mount to existing components, or it may involve the machining of specialized adaptors that include integral male or female union connectors. An example of an embodiment using nipples is shown in FIG. 7, which shows an isolator valve 90 joined to a female union connector 91 via a threaded nipple 92, which is threaded into the second end 93 of the body of valve 90. The male union connector 94 is joined to isolator valve 90 via a threaded nipple 95, which is threaded into the first end 96 of the body of valve 90 and thus capturing nut 97.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hot water heating system comprising:

a source of hot water;

a first isolator valve in fluid communication with said source of hot water;

a flow control valve in fluid communication with said first isolator valve;

a circulator in fluid communication with said first isolator valve and said flow control valve; and a second isolator valve in fluid communication with said first isolator valve, said flow control valve, and said circulator;

wherein each of said first isolator valve, said flow control valve, said circulator, and said second isolator valve comprise a first end and a second end;

wherein each first end comprises a male union connector and each second end comprises a female union connector; and wherein each male union connector is dimensioned to mate with each female union connector.

2. The system as claimed in claim 1 further comprising a degassing means for removing entrained gas from a liquid flowing through said system.

3. The system as claimed in claim 2 wherein said degassing means is a microbubble air vent.

4. The system as claimed in claim 3 further comprising a tempering valve in fluid communication with said first isolator valve, said flow control valve, said circulator, and said second isolator valve.

5. The system as claimed in claim 4 further comprising a temperature gauge in fluid communication with said first isolator valve, said flow control valve, said circulator, said tempering valve, and said second isolator valve, wherein said temperature gauge is disposed at a location downstream of said tempering valve.

6. The system as claimed in claim 5 further comprising a radiant tube distribution manifold in fluid communication with said first isolator valve, said flow control valve, said circulator, and said second isolator valve, wherein said radiant tube distribution manifold is disposed at a location downstream of said second isolator valve.

7. The system as claimed in claim 6 wherein each of said tempering valve and said temperature gauge comprises a first end and a second end;

wherein each first end comprises a male union connector and each second end comprises a female union connector; and wherein each male union connector is dimensioned to mate with each female union connector.

8. The system as claimed in claim 2 wherein said degassing means is an air scoop.

9. The system as claimed in claim 2 wherein each first end is an upstream end and wherein each second end is a downstream end.

10. The system as claimed in claim 2 further comprising a zone distribution manifold in fluid communication with, and disposed at a location downstream from, said degassing means;

wherein each first end is an upstream end and wherein each second end is a downstream end; and wherein said zone distribution manifold comprises at least one male union connector.

11. A kit of parts for forming a hot water heating system, said kit comprising:

a first isolator valve;

a flow control valve;

a circulator; and a second isolator valve;

wherein each of said first isolator valve, said flow control valve, said circulator, and said second isolator valve comprise a first end and a second end;

wherein each first end comprises a male union connector and each second end comprises a female union connector; and wherein each male union connector is dimensioned to mate with each female union connector to form a hot water heating system.

12. The kit as claimed in claim 11 further comprising a degassing means for removing entrained gas from a liquid flowing through said hot water heating system.

13. The kit as claimed in claim 12 wherein said degassing means is a microbubble air vent.

14. The kit as claimed in claim 13 further comprising a tempering valve dimensioned for disposal in fluid communication with said first isolator valve, said flow control valve, said circulator, and said second isolator valve.

15. The kit as claimed in claim 14 further comprising a temperature gauge dimensioned for disposal in fluid communication with said first isolator valve, said flow control valve, said circulator, said tempering valve, and said second isolator valve.

16. The kit as claimed in claim 15 further comprising a radiant tube distribution manifold dimensioned for disposal in fluid communication with said first isolator valve, said flow control valve, said circulator, said temperature gauge, said tempering valve and said second isolator valve.

17. The kit as claimed in claim 16 wherein each of said tempering valve and said temperature gauge comprises a first end and a second end;

wherein each first end comprises a male union connector and each second end comprises a female union connector; and wherein each male union connector is dimensioned to mate with each female union connector.

18. The kit as claimed in claim 12 wherein said degassing means is an air scoop.

19. The kit as claimed in claim 12 wherein each first end is an upstream end and wherein each second end is a downstream end.

20. The kit as claimed in claim 12 further comprising at least one offset connector;

wherein each of said at least one offset connector comprises a first end and a second end;

wherein each first end comprises a male union connector and each second end comprises a female union connector; and wherein each male union connector is dimensioned to mate with each female union connector.

* * * * *